US008613439B2

(12) United States Patent
Morita et al.

(10) Patent No.: US 8,613,439 B2
(45) Date of Patent: Dec. 24, 2013

(54) SHEET FEEDING APPARATUS AND IMAGE FORMING APPARATUS

(71) Applicant: Canon Kabushiki Kaisha, Tokyo (JP)

(72) Inventors: Tomokazu Morita, Mishima (JP); Junji Yasuda, Kawasaki (JP); Shinichi Nishida, Kawasaki (JP); Masashige Tamura, Kawasaki (JP); Kazumasa Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/737,107

(22) Filed: Jan. 9, 2013

(65) Prior Publication Data

US 2013/0181392 A1 Jul. 18, 2013

(30) Foreign Application Priority Data

Jan. 12, 2012 (JP) ..... 2012-004053

(51) Int. Cl.
*B65H 3/52* (2006.01)

(52) U.S. Cl.
USPC ..... 271/121; 271/126; 271/148; 271/167

(58) Field of Classification Search
USPC ..... 271/121, 126, 148, 160, 167, 147
See application file for complete search history.

(56) References Cited

FOREIGN PATENT DOCUMENTS

| | | |
|---|---|---|
| JP | 5-147752 A | 6/1993 |
| JP | 2000-143002 A | 5/2000 |

*Primary Examiner* — Michael McCullough
(74) *Attorney, Agent, or Firm* — Canon USA Inc IP Division

(57) ABSTRACT

The present invention is directed to a sheet feeding apparatus including a sheet feeding unit capable of feeding sheets stacked on a sheet stacking face of a sheet stack tray, wherein the sheet feeding unit includes a feeding roller configured to feed the sheets, a driving motor configured to rotate the feeding roller, a lifting member configured to move at least edges of the sheets in a direction of the feeding roller, a sheet-shaped member connected to a front end of the lifting member at the downstream side, and a counter member disposed opposite to the feeding roller to pinch the sheet-shaped member, wherein, when the feeding roller is rotated, the sheet-shaped member is moved to the downstream side to cause the lifting member to move, and when the sheets are brought into contact with the feeding roller, the contacted uppermost sheet is fed by the feeding roller.

6 Claims, 17 Drawing Sheets

SHEET FEEDING APPARATUS AND IMAGE FORMING APPARATUS

BACKGROUND OF THE INVENTION

1. Field of the Invention

The present disclosure relates to a sheet feeding apparatus capable of separating sheets to feed thus separated sheets one by one and an image forming apparatus equipped with the sheet feeding apparatus.

2. Description of the Related Art

Generally, in an image forming apparatus such as a printer, a facsimile, and a copying machine, a body of the image forming apparatus includes integrally or detachably a sheet feeding apparatus for automatically feeding a recording material such as plain paper, coated paper, and an overhead projector (OHP) sheet (hereinafter simply referred to as "sheet") to an image forming unit of the image forming apparatus. The sheet feeding apparatus is equipped with a separation feeding unit for separating sheets to feed thus separated sheets one by one to an image forming unit. The image forming unit forms an image on the sheet having been separated and fed one by one from the sheet feeding apparatus. Therefore, in the sheet feeding apparatus, it is one of challenges to separate the sheets and feed the separated sheet to the image forming unit continuously one by one. Accordingly, various feeding methods are proposed to prevent double feeding in which a plurality of sheets is conveyed at a time.

Lately, more downsizing of the image forming apparatus is demanded due to a wide spread of the image forming apparatus into typical households. Therefore, in the image forming apparatus equipped with the sheet feeding apparatus including a sheet stack tray on which sheets are stacked, it is demanded that a length of the apparatus body in a sheet feeding direction (e.g., a depth) would not be longer than a length of the sheet stack tray in the sheet feeding direction. To meet the above described demand, proposed is an image forming apparatus in which a sheet is conveyed in a direction opposite to the sheet feeding direction and the sheet is once flexed by bringing the sheet into contact with a trailing edge wall of the sheet stack tray, followed by running-on of a sheet over a separation claw and by separating and conveying the sheet by means of the separation claw, resulting in separation feeding of the sheets within the sheet stack tray of the current size. The above described technique is discussed in Japanese Patent Application Laid-Open No. 05-147752.

These days, in addition to the above descried demand of downsizing of the image forming apparatus, another challenge is to steadily feed various types of sheets having different thicknesses. More specifically, a problem to solve is how to steadily feed a sheet having less rigidity (e.g., a thin paper). To solve the above described problem, such an image forming apparatus is proposed that the sheets are stacked on the sheet stack tray in a manner such that the sheets are curled in a direction orthogonal to the sheet feeding direction, thereby enhancing apparent rigidity of the sheets in the sheet feeding direction and the thin papers are properly dealt with on a surface of a slope, resulting in preventing double feed of the thin papers. The technique is discussed in Japanese Patent Application Laid-Open No. 2000-143002.

However, the image forming apparatus discussed in Japanese Patent Application Laid-Open No. 05-147752 requires a space for causing the sheets to be flexed and thus the downsizing of the image forming apparatus is hard to achieve. On the other hand, the image forming apparatus discussed in Japanese Patent Application Laid-Open No. 2000-143002 requires no space for causing the sheets to be flexed; however, since the sheets are stacked in a curved condition for a long period of time in such image forming apparatus, the sheets are curled and fixed in a curling shape, which may invite a faulty conveyance such as a sheet jam while the sheets are fed, and further which may invite a faulty transfer of an image while the images are transferred to the sheets. If after the images are formed and discharged, the sheets are curled and fixed in the curling shape, quality of the sheets as printed matters is degraded.

SUMMARY OF THE INVENTION

The present disclosure is directed to a sheet feeding apparatus for suppressing generation of a faulty conveyance and degradation of sheet quality while realizing downsizing thereof, and an image forming apparatus equipped with the sheet feeding apparatus.

According to an aspect of the present disclosure, a sheet feeding apparatus for feeding sheets stacked on a sheet stacking face of a sheet stack tray includes a feeding roller configured to feed the sheets, a driving motor configured to rotate the feeding roller, a lifting member configured to to move at least edges of the sheets in a direction of the feeding roller, a sheet-shaped member connected to a front end of the lifting member at a downstream side in a sheet conveyance direction, and a counter member configured to pinch the sheet-shaped member, the counter member disposed opposing the feeding roller and facing the feeding roller across the sheet-shaped member. When the feeding roller is rotated, the sheet-shaped member pinched between the feeding roller and the counter member is moved to a downstream side in the sheet conveyance direction to cause the lifting member to move and, when the sheets are brought into contact with the feeding roller, the thus contacted uppermost sheet of on the sheet stacking face of the sheet stack tray is fed by the feeding roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles as disclosed herein.

7B is a cross sectional view schematically illustrating a state where the lifting member is rotated to bring the sheets into contact with a feeding roller.

Figure 8A:
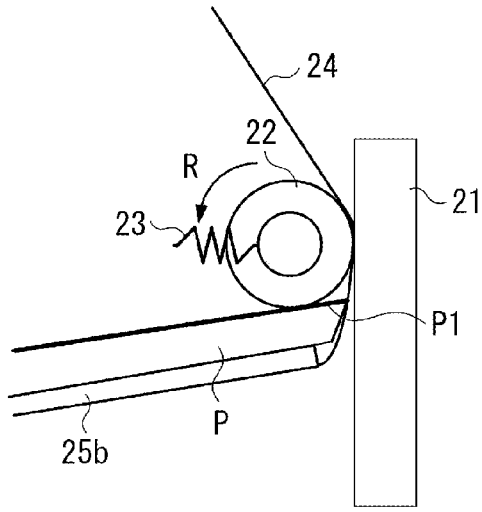
Figure 8B:
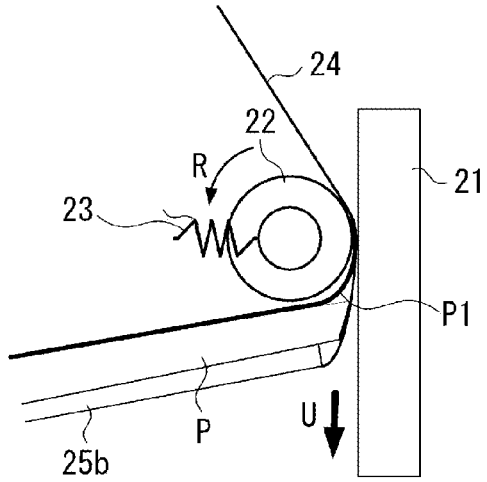
Figure 8C:
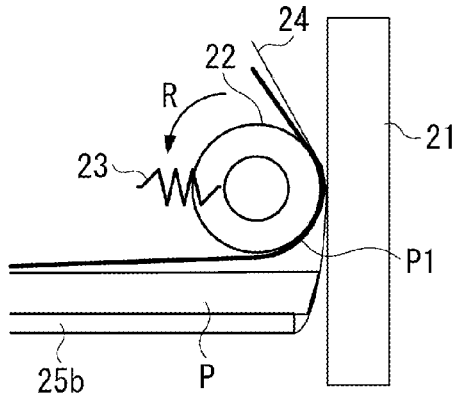

FIG. 8A is a cross sectional view schematically illustrating a state where the sheets are brought into contact with the feeding roller. FIG. 8B is a cross sectional view schematically illustrating a state where a piece of sheet is pinched by a nip portion formed between the feeding roller and the sheet-shaped member. FIG. 8C is a cross sectional view schematically illustrating a state where the lifting member returns to an initial position.

Figure 9:
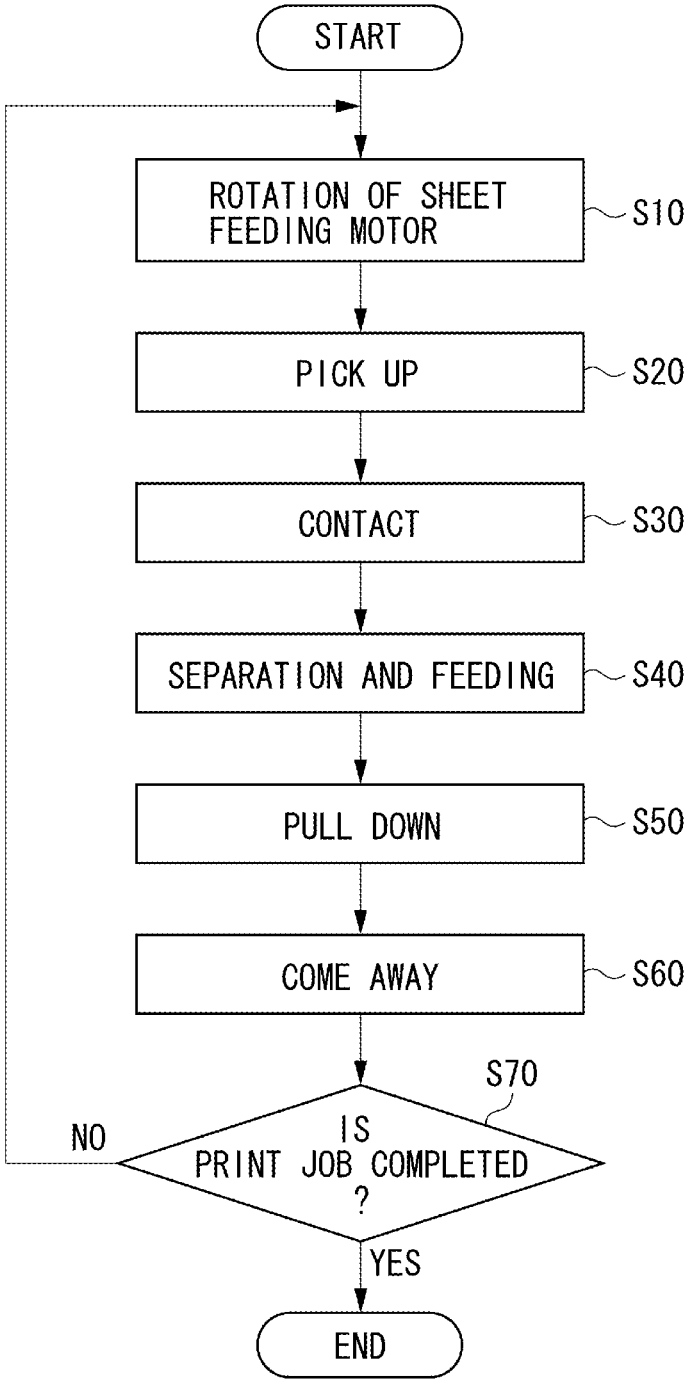

FIG. 9 is a flow chart illustrating a sheet feeding operation in a sheet feeding unit according to the first exemplary embodiment.

Figure 10A:
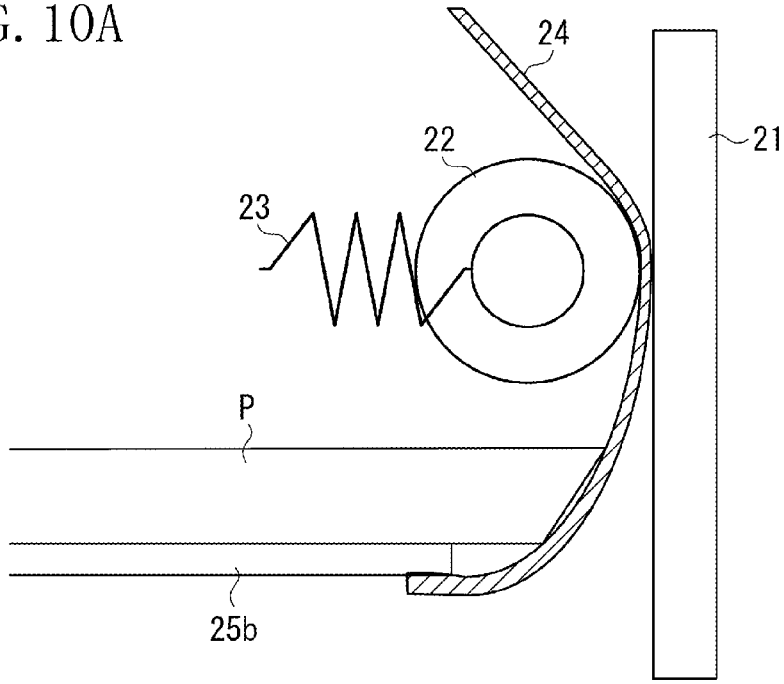
Figure 10B:
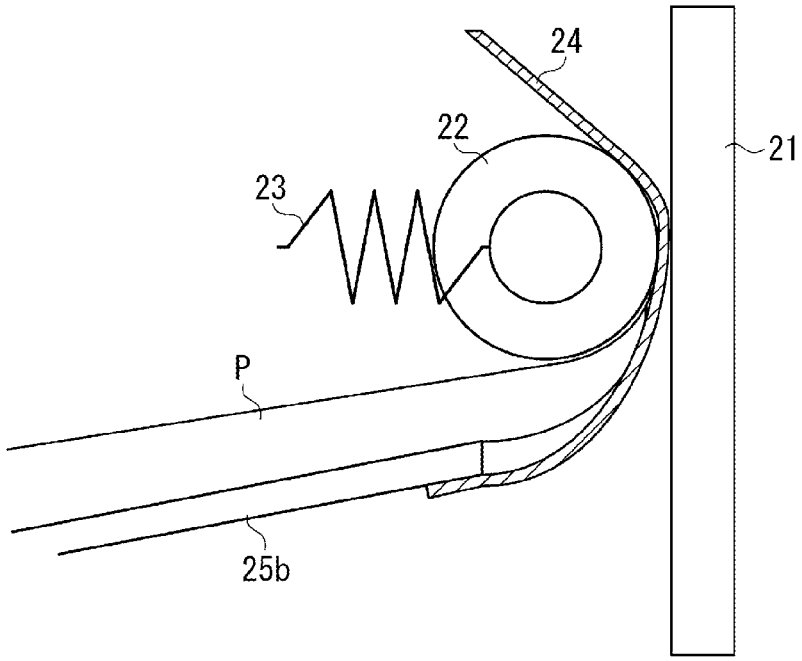

FIG. 10A illustrates a state where the sheet-shaped member descends to cause the sheets to come down. FIG. 10B illustrates a state where the sheet-shaped member is lifted to bring the sheets into contact with the feeding roller.

Figure 11A:
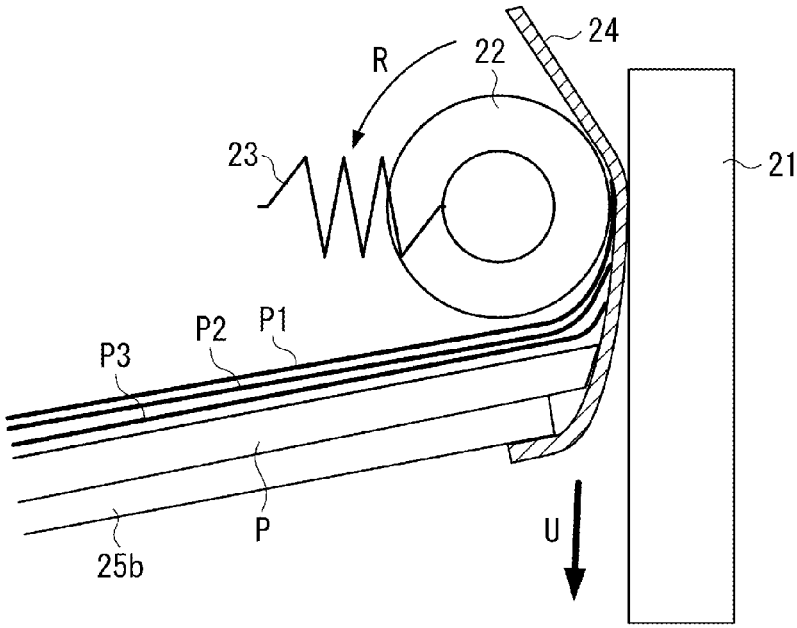
Figure 11B:
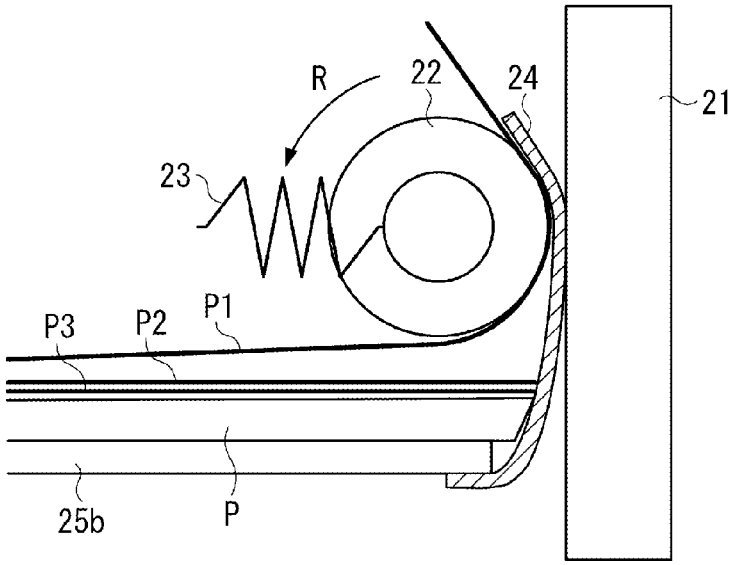

FIG. 11A illustrates a state where a plurality of sheets comes into the nip portion. FIG. 11B illustrates a state where only the uppermost sheet is fed.

Figure 12:
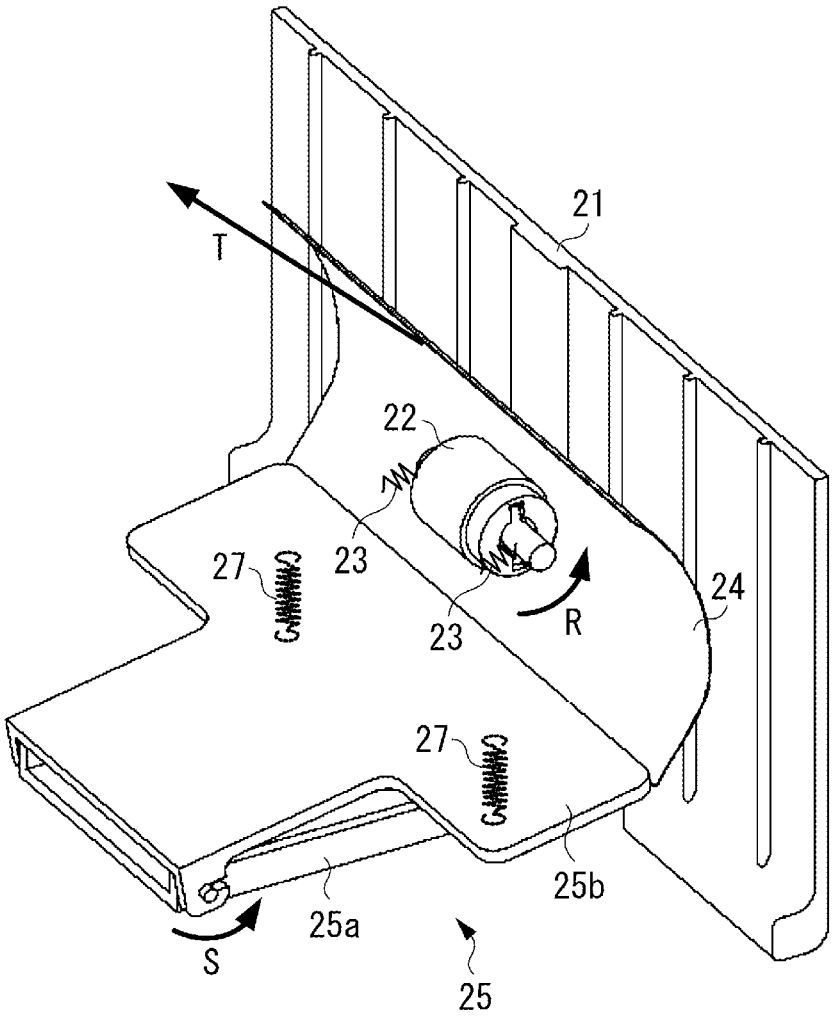

FIG. 12 is a perspective view illustrating a lifting unit according to a second exemplary embodiment in a state where the lifting unit is detached from the sheet stack tray.

Figure 13A:
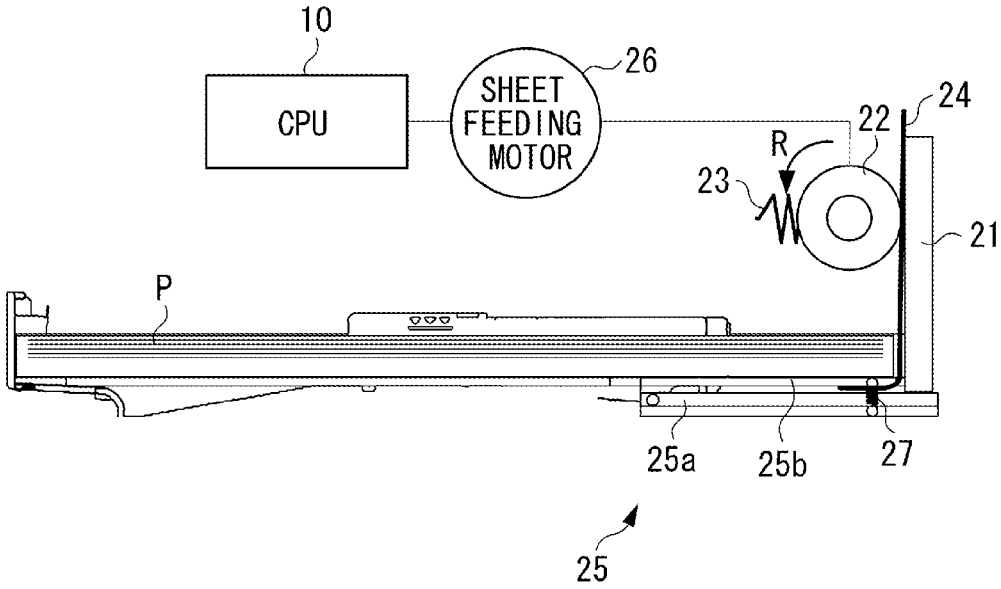
Figure 13B:
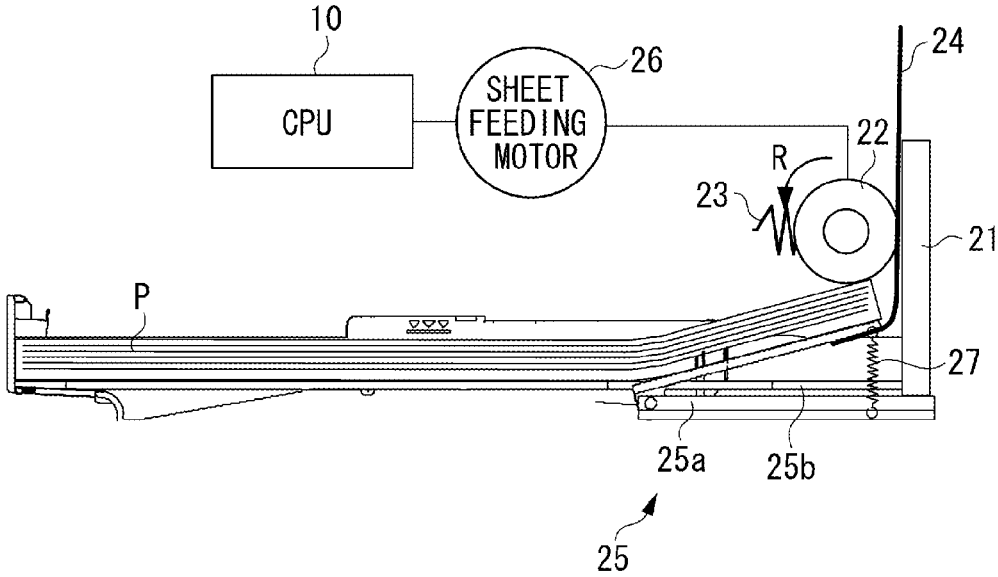

FIG. 13A is a cross sectional view schematically illustrating a state where sheets are stacked in a sheet feeding unit according to a second exemplary embodiment. FIG. 13B is a cross sectional view schematically illustrating a state where the sheets are brought into contact with the feeding roller.

Figure 14:
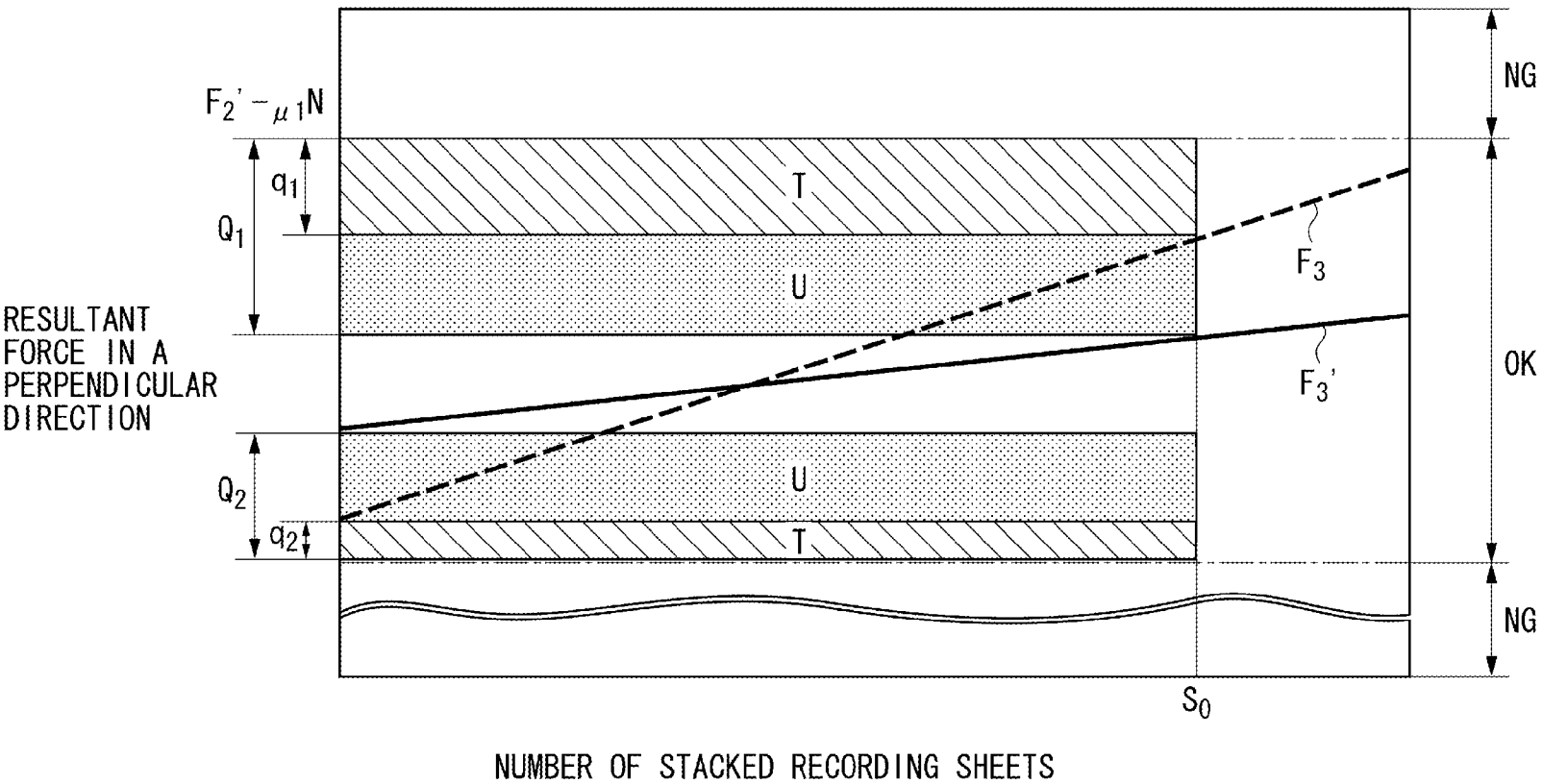

FIG. 14 illustrates a relationship between the number of stacked sheets and a resultant force in a vertical direction.

Figure 15A:
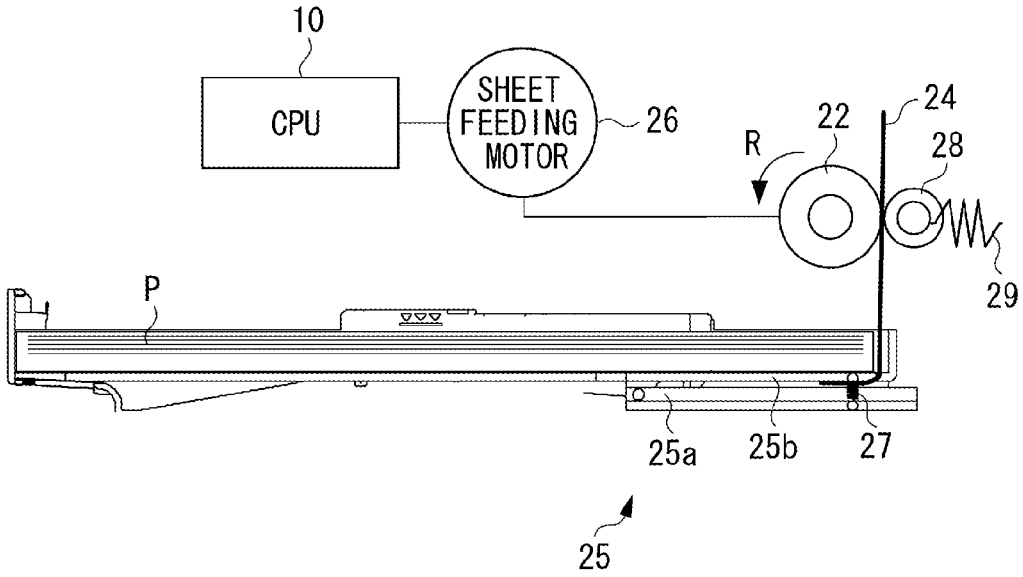
Figure 15B:
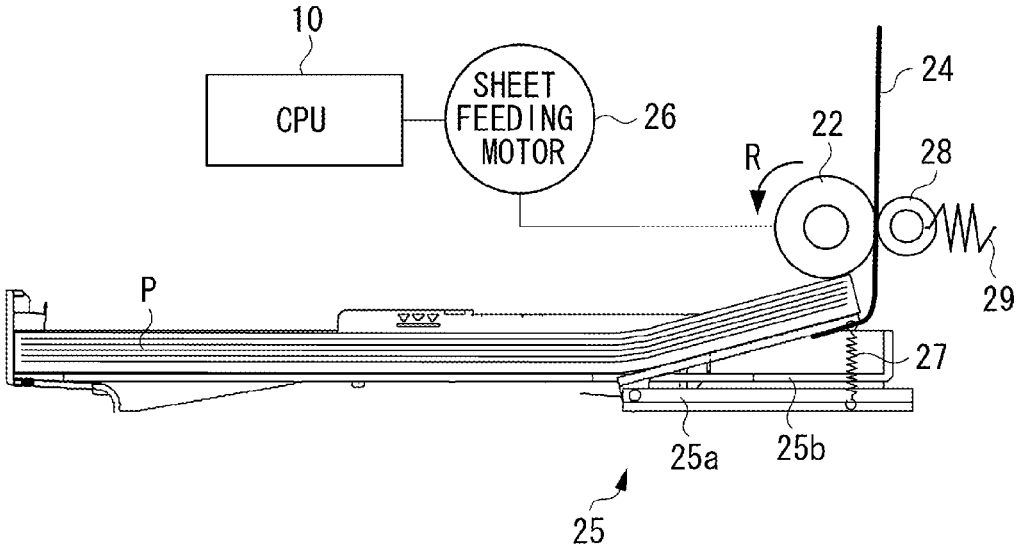

FIG. 15A is a cross sectional view schematically illustrating a state where the sheets are stacked in a sheet feeding unit according to a third exemplary embodiment. FIG. 15B is a cross sectional view schematically illustrating a state where sheets are brought into contact with a feeding roller.

Figure 16A:
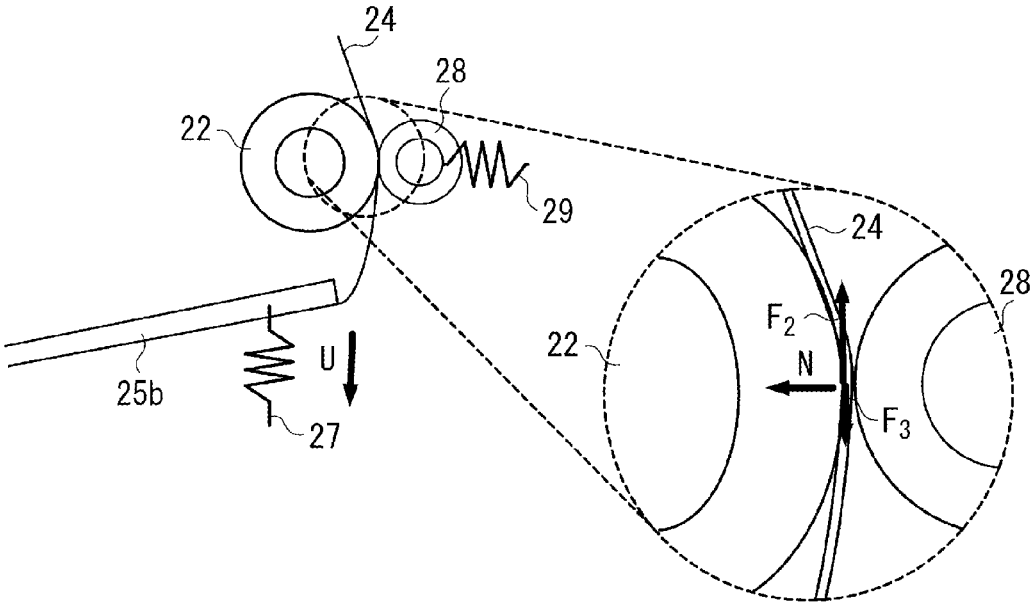
Figure 16B:
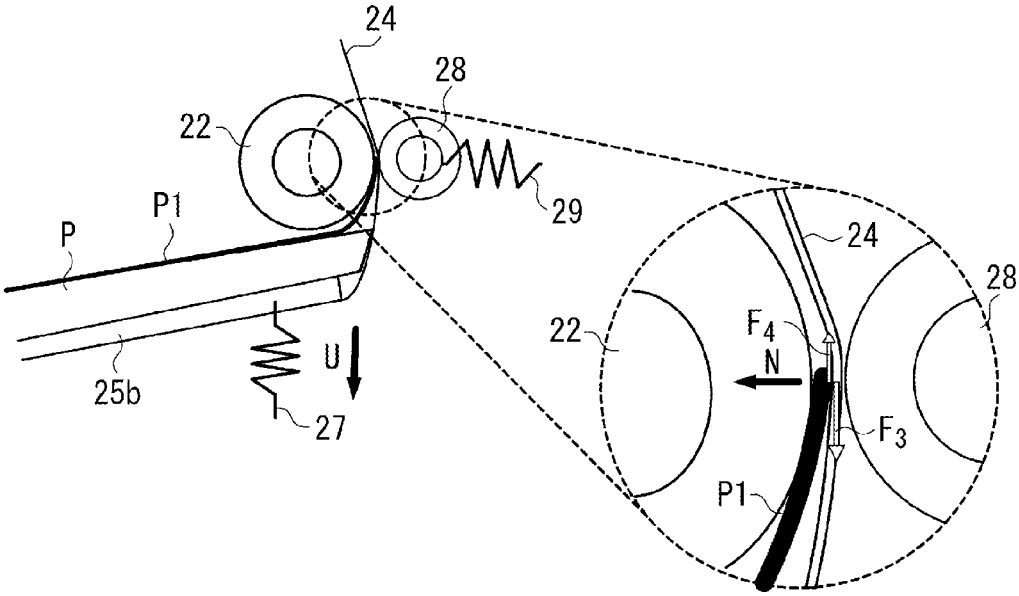

FIG. 16A is a partially enlarged cross sectional view schematically illustrating the lifting unit illustrated in FIG. 15B. FIG. 16B is a partially enlarged cross sectional view schematically illustrating a state where a sheet comes into a nip portion of FIG. 16A.

Figure 17:
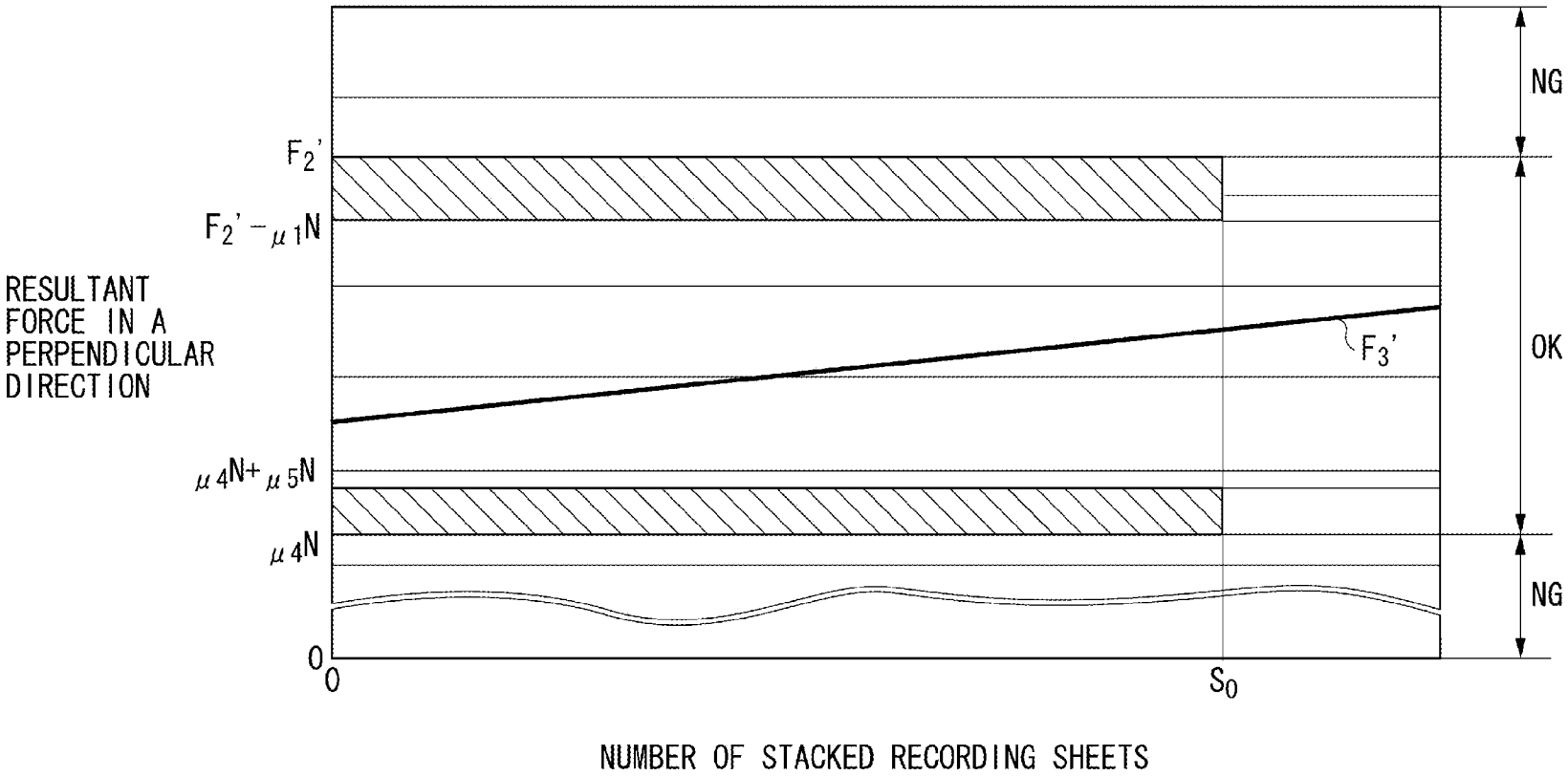

FIG. 17 illustrates a relationship between the number of stacked sheets and a resultant force in a vertical direction.

DESCRIPTION OF THE EMBODIMENTS

Various exemplary embodiments, features, and aspects of the invention will be described in detail below with reference to the drawings.

An image forming apparatus equipped with a sheet feeding unit as a sheet feeding apparatus according to an exemplary embodiment of the present disclosure is described below with reference to the drawings attached hereto. The image forming apparatus according to the exemplary embodiment of the present disclosure is directed to an image forming apparatus equipped with a sheet feeding unit capable of automatically feeding a sheet to an image forming unit such as a copying machine, a printer, a facsimile, and a multi-purpose peripherals. In the following exemplary embodiment, a full-color laser printer 1 (hereinafter simply referred to as "laser printer") employing an in-line system and an intermediate transfer system is described for the sake of description. Terms representing a direction such as up, down, vertical, and horizontal indicates, unless otherwise noted, a direction under a condition that the laser printer 1 is being viewed operating in a normal condition.

Figure 1:
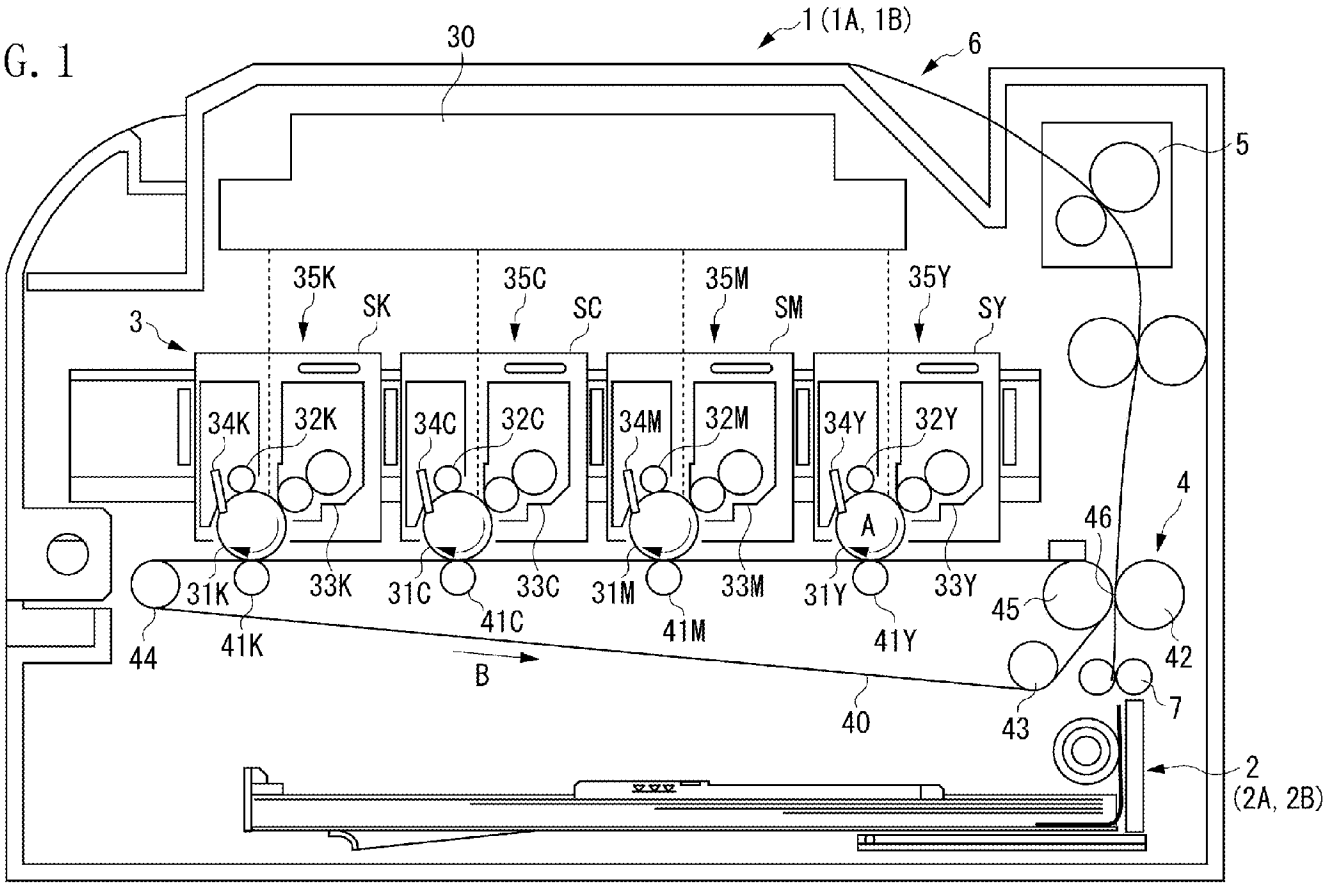
FIG. 1 is a cross sectional view schematically illustrating an entire configuration of a laser printer according to an exemplary embodiment.

The laser printer 1 according to a first exemplary embodiment is described below with reference to FIGS. 1 through 11. An entire configuration of the laser printer 1 according to the first exemplary embodiment is described below with reference to FIG. 1. FIG. 1 is a cross sectional view schematically illustrating an entire configuration of the laser printer 1 according to the exemplary embodiment.

As illustrated in FIG. 1, the laser printer 1 according to the present exemplary embodiment is equipped with a sheet feeding unit 2 configured to feed sheets P, an image forming unit 3 configured to form an image, and a transfer unit 4 configured to transfer images formed by the image forming unit 3 to the sheets P. The laser printer 1 is further equipped with a fixing unit 5 configured to fix a unfixed image transferred from the transfer unit 4 and a sheet discharging unit 6 configured to discharge the sheets P on which the images are fixed.

The sheet feeding unit 2 is disposed in a lower section of the laser printer 1 and is configured to separate the sheets P one by one to feed thus separated sheet to the image forming unit 3. The sheet feeding unit 2 is described below in detail.

The image forming unit 3 is disposed above the sheet feeding unit 2 and is equipped with an exposure device 30 and first through fourth image forming units SY, SM, SC, and SK configured to form images of four colors of yellow (Y), magenta (M), cyan (C), and black (K). In the present exemplary embodiment, the first through the fourth image forming units SY, SM, SC, and SK are disposed in a line in a direction approximately orthogonal to a vertical direction and the exposure device 30 is disposed above the first through the fourth image forming units SY, SM, SC, and SK.

The first through the fourth image forming units SY, SM, SC, and SK are configured to be identical to each other except that the image forming units form images of different colors. Therefore, a configuration of the first image forming unit SY for forming an image of yellow is described below and descriptions of configurations of the second through the fourth image forming units SM, SC, and SK are omitted.

The first image forming unit SY is equipped with a photosensitive drum 31Y, a charging roller 32Y, a developing unit 33Y, and a cleaning member 34Y. The photosensitive drum 31Y is formed into a drum-like shape and is disposed so as to be rotatably driven in an arrow A direction illustrated in FIG. 1 by a driving motor (not illustrated). The charging roller 32Y uniformly charges a surface of the photosensitive drum 31Y. The developing unit 33Y develops an electrostatic latent image formed on a surface of the photosensitive drum 31Y by the exposure device 30 with a nonmagnetic single component developer (i.e., a toner) as a developer.

In the present exemplary embodiment, the developing unit 33Y brings the developing roller into contact with the photosensitive drum 31Y for reversal development. In other words, the developing unit 33Y develops the electrostatic latent image by attaching the toner charged in a polarity identical to a charging polarity on the photosensitive drum 31Y (i.e., a negative polarity in the present exemplary embodiment), to a portion on the photosensitive drum 31Y (i.e., an imaging unit, an exposure unit) in which electric charge has decayed by an exposure. A cleaning member 34Y removes the toner remaining on the surface of the photosensitive drum 31Y (i.e., a residual transfer toner). The exposure device 30 irradiates the photosensitive drum 31Y with a laser light to form an electrostatic latent image on the surface of the photosensitive drum 31Y.

In the present exemplary embodiment, the photosensitive drum 31Y, the charging roller 32Y, the developing unit 33Y, and the cleaning member 34Y are integrally formed into a cartridge, i.e., a process cartridge 35Y. The process cartridge 35Y is detachable from the laser printer 1 by means of a mounting guide (not illustrated) and a positioning member (not illustrated) provided on the laser printer 1. In the present exemplary embodiment, all the process cartridges of the different colors are formed into the same shape and the respective process cartridges contain toners of yellow (Y) color, magenta (M) color, cyan (C) color, and black (K) color.

The transfer unit 4 is equipped with an endless intermediate transfer belt 40, a primary transfer roller 41Y, and a secondary transfer roller 42. The intermediate transfer belt 40 is stretched over a drive roller 43, a driven roller 44, and a secondary transfer counter roller 45 such that the intermediate transfer belt 40 contacts all the photosensitive drums. The intermediate transfer belt 40 rotates in an arrow B direction as illustrated in FIG. 1.

A primary transfer roller 41Y is disposed at a side of an inner periphery of the intermediate transfer belt 40 so as to be opposed to the photosensitive drum 31Y. The primary transfer roller 41Y presses the intermediate transfer belt 40 against the photosensitive drum 31Y to form a primary transfer unit in which the intermediate transfer belt 40 contacts the photosensitive drum 31Y.

A secondary transfer roller 42 is disposed facing to a secondary transfer counter roller 45 so as to pressure-contact the secondary transfer counter roller 45 via the intermediate transfer belt 40, thereby composing a secondary transfer unit 46 in which the intermediate transfer belt 40 contacts the secondary transfer roller 42.

The fixing unit 5 is disposed in a downstream side of the secondary transfer unit 46 in a sheet conveyance direction (hereinafter simply referred to as "downstream side") to fix an unfixed toner image transferred in the secondary transfer unit 46 by heating and pressing. A sheet discharging unit 6 is disposed in an upper section and in a downstream side of the fixing unit 5 of the laser printer 1. The sheet discharging unit 6 stacks the discharged sheets P after the sheets P are subjected to the fixing processing by the fixing unit 5.

Now, image forming processing performed by the laser printer 1 according to the present exemplary embodiment having the above described configuration is described below. When the image forming processing is started, image information is input into the laser printer 1 from the image reading apparatus (not illustrated) connected to the laser printer 1 or a host device such as a personal computer communicably connected to the laser printer 1. When the image information is input into the laser printer 1, the photosensitive drum 31Y is irradiated with a laser light from the exposure device 30 according to an image signal of a yellow component color of a document based on the input image information. Accordingly, a surface of the photosensitive drum 31Y uniformly charged to a predetermined polarity and potential is exposed to the laser light to form an electrostatic latent image of the yellow color.

The electrostatic latent image of the yellow color is developed with a yellow toner of the developing unit 33Y to visualize the electrostatic latent image as a yellow toner image. Subsequently, when the yellow toner image reaches the primary transfer unit at which the photosensitive drum 31Y contacts the intermediate transfer belt 40 owing to rotation of the photosensitive drum 31Y, a primary transfer bias having a polarity opposite to a charging polarity of the toner is applied from the primary transfer bias supply. Accordingly, the yellow toner image is primary transferred to the intermediate transfer belt 40.

When the yellow toner image is primarily transferred onto the intermediate transfer belt 40, a magenta toner image, a cyan toner image, and a black toner image similarly formed on the corresponding photosensitive drums 31M, 31C, and 31K are sequentially superimposed on the yellow toner image and transferred onto the intermediate transfer belt 40. Accordingly, a full color toner image is formed on the intermediate transfer belt 40.

In parallel with a forming operation of forming the full color toner image, the sheets P stacked in the sheet feeding unit 2 is separated and sent out one by one and conveyed to the secondary transfer unit 46 at predetermined timing by a resist roller pair 7 provided in a downstream side of the sheet feeding unit 2 . When the sheets P are conveyed to the secondary transfer unit 46 at the predetermined timing, a secondary transfer bias of a polarity opposite to a charging polarity of the toner is applied from the secondary transfer bias supply and the full color toner images on the intermediate transfer belt 40 are collectively transferred onto the sheets P (i.e., secondary transfer).

The sheets P onto which the toner images are transferred are guided to a conveyance guide to be conveyed from the secondary transfer unit 46 to the fixing unit 5. Subsequently, the toners of the full color images are fused and mixed by heating and pressing in the fixing unit 5, so that the full color images are fixed on the sheets. Then, the sheets P on which the images are fixed are discharged to the sheet discharging unit 6 and the image forming processing is ended.

Figure 2A:
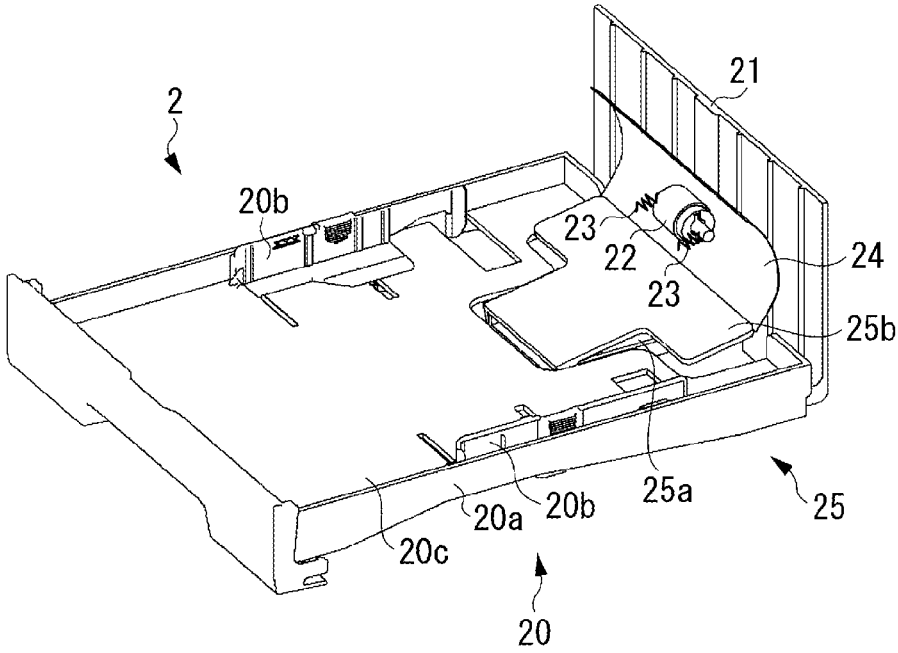
FIG. 2A is a perspective view illustrating a sheet feeding unit according to a first exemplary embodiment.
Figure 2B:
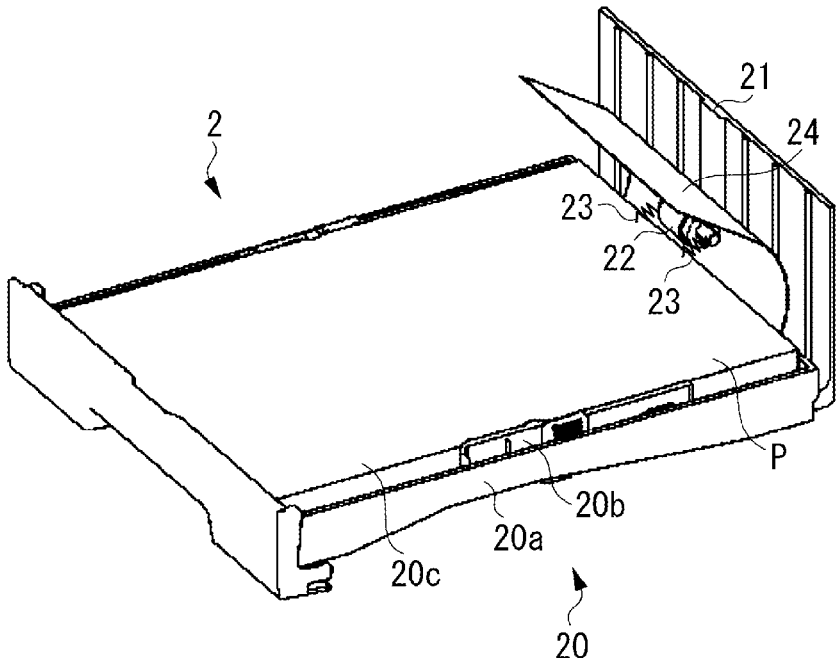
FIG. 2B is a perspective view illustrating a state where sheets are stacked in the sheet feeding unit illustrated in FIG. 2A.
Figure 3:
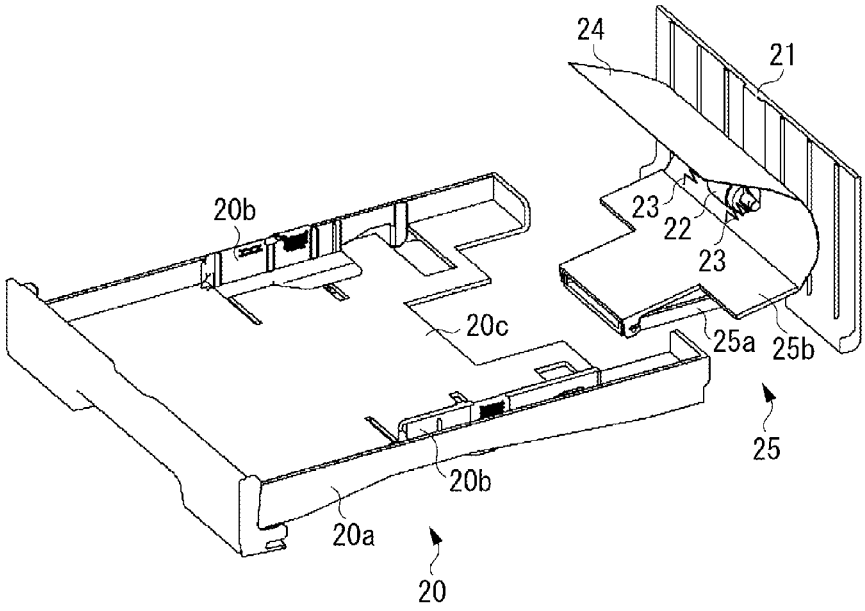
FIG. 3 is a perspective view illustrating a state where a lifting unit is detached from the sheet stack tray.
Figure 4:
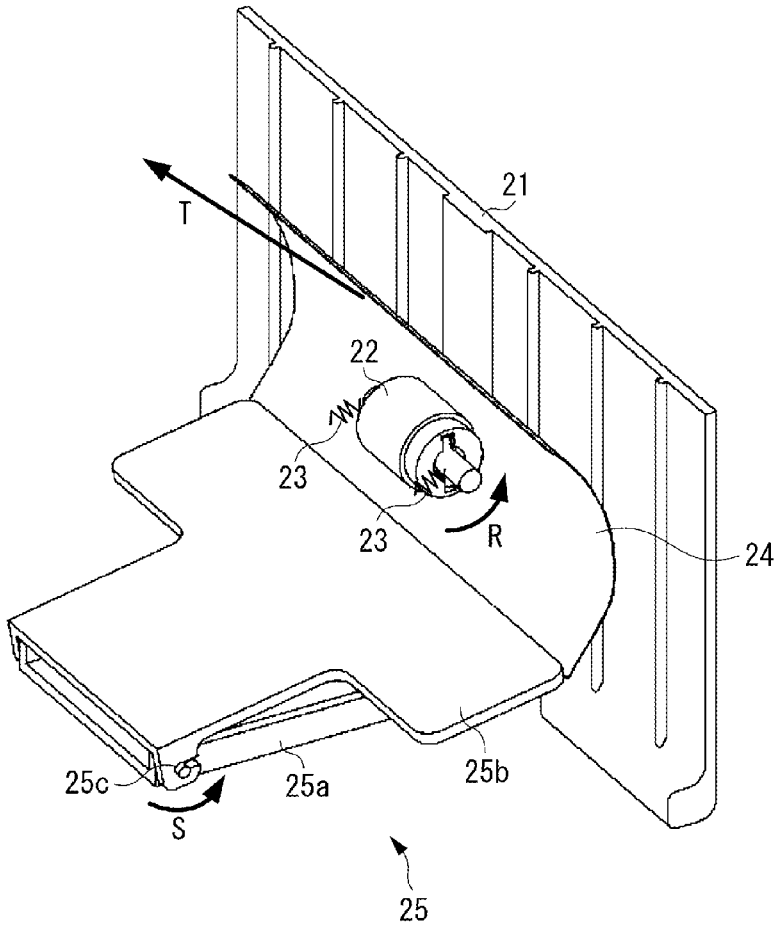
FIG. 4 is a perspective view illustrating the lifting unit detached from the sheet stack tray.

The sheet feeding unit 2 according to the first exemplary embodiment is described below with reference to FIGS. 2 through 11. Firstly, a schematic configuration of the sheet feeding unit 2 is described with reference to FIGS. 2 through 4. FIG. 2A is a perspective view illustrating the sheet feeding unit 2 according to the first exemplary embodiment. FIG. 2B is a perspective view illustrating a state where the sheets P are stacked on the sheet feeding unit 2 illustrated in FIG. 2A. FIG. 3 is a perspective view illustrating a state where a lifting unit is detached from the sheet stack tray 20. FIG. 4 illustrates a perspective view of the lifting unit detached from the sheet stack tray 20.

As illustrated in FIGS. 2A and 2B, the sheet feeding unit 2 according to the first exemplary embodiment is equipped with a sheet stack tray 20, a counter member 21, a feeding roller 22, a paired first pressure springs 23, a sheet-shaped member 24, and a lifting unit 25. The sheet feeding unit 2 is equipped with a feed motor 26 as a driving motor (see, FIG. 7).

The sheet stack tray 20 is equipped with a tray body 20*a* configured to stack sheets P to be fed, and a paired sheet regulating plates 20*b* configured to control movement of the sheets P stacked in the tray body 20*a* in a sheet width direction orthogonal to the sheet feeding direction. The tray body 20*a* is equipped with a sheet stacking face 20*c* and the sheets P are stacked on the sheet stacking face 20*c*.

The paired sheet regulating plates 20*b* are supported on the sheet stacking face 20*c* of the tray body 20*a* movable in the sheet width direction and controls the sheets P on the sheet stacking face 20*c* in the width direction thereof by moving the paired sheet regulating plates 20*b* according to a size of the sheets P to prevent the sheets P stacked on the sheet stacking face 20*c* from being fed in a skewed state. The sheet stack tray 20 is configured such that the sheet stack tray 20 is detachable from the lifting unit 25 as illustrated in FIG. 3. In a case where the sheets P stacked in the tray body 20*a* run out, the sheets P can be supplied to the tray body 20*a* by detaching the sheet stack tray 20.

A counter member 21 is a plate-like member having a substantial rectangular shape formed of a polycarbonate/acrylonitrile-butadiene-styrene (ABS) resin and is standing vertically at an edge in the downstream side of the sheet stack tray 20 in the sheet feeding direction. A surface of a side of the sheet stack tray 20 of the counter member 21 is uneven.

The feeding roller 22 includes a roller surface around a shaft provided with an ethylene propylene diene monomer rubber (EPDM). The feeding roller 22 is rotatably supported so as to face the counter member 21 above the sheets P stacked on the sheet stack tray 20. The feeding roller 22 is disposed at a position away from (i.e., above) the sheets P stacked on the tray body 20*a* in a case where the below described lifting member 25*b* is in an initial position as illustrated in FIG. 2B. The initial position is a position of the lifting member 25*b* before the feeding operation of the sheet feeding unit 2 is started.

Further, a rotation shaft of the feeding roller 22 is pressed against the counter member 21 by the paired first pressure springs 23 and 23. Accordingly, a nip portion is formed between the feeding roller 22 and the counter member 21.

The sheet-shaped member 24 is formed of a polyester film having a thickness of 150 μm in a substantial rectangular shape. The sheet-shaped member 24 is pinched by the nip portion formed between the counter member 21 and the deliver roller 22. A lower edge of the sheet-shaped member 24 is connected to a leading edge of the lifting unit 25 (i.e., a leading edge of a downstream side), whereas an upper edge of the sheet-shaped member 24 is left as a free end. The sheet-shaped member 24 can be manufactured using, other than the polyester film, a resin-made sheet having flexibility such as a polyphenylene sulfide film and a polycarbonate film, each having a suitable thickness of a range between 50 μm and 250 μm.

As illustrated in FIG. 4, the lifting unit 25 is equipped with a bottom plate 25*a* fixed to the laser printer 1, and a lifting member 25*b* rotatably supported by the bottom plate 25*a*. A raised portion 25*c* of the bottom plate 25*a* is utilized as a rotation point. The lifting member 25*b* is formed such that a weight is attachable on a rear surface side thereof. With the weight, a self weight of the lifting member 25*b* can be controlled. A feed motor 26 is connected to the feeding roller 22 and causes the feeding roller 22 to rotate according to a signal received from a central processing unit 10 (a control unit) illustrated in FIG. 7 which will be described below.

Figure 5:
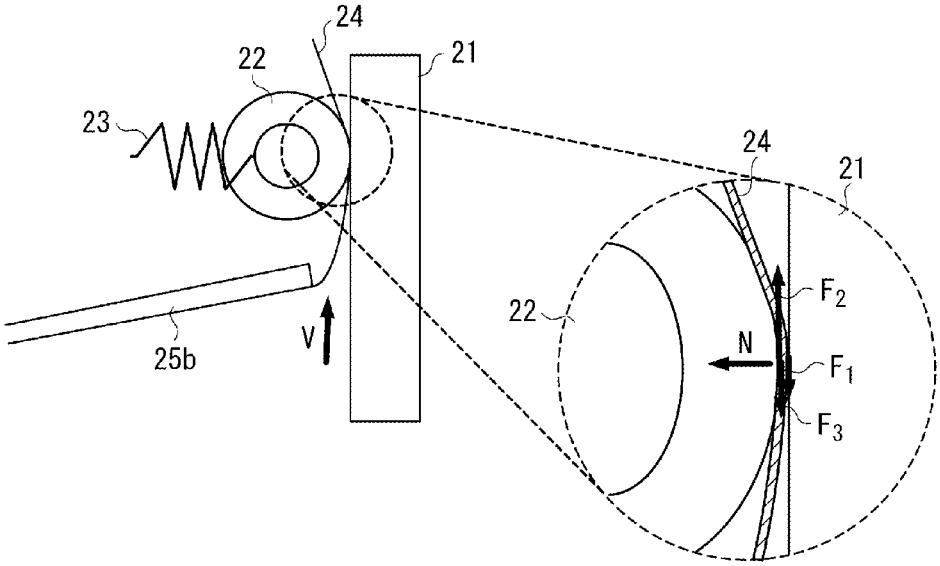
FIG. 5 is a partially enlarged cross sectional view schematically illustrating the lifting unit illustrated in FIG. 4.

Conditions for lifting up the sheet-shaped member 24 at the nip portion formed between the feeding roller 22 and the counter member 21 in an upward direction V is described below with reference to FIG. 5 in addition to FIG. 4. FIG. 5 is a partially enlarged cross sectional view schematically illustrating a lifting unit 25 illustrated in FIG. 4.

In the sheet feeding unit 2 according to the first exemplary embodiment as above described, when the feeding roller 22 is rotated in an arrow R direction illustrated in FIG. 4, an upwardly lifting force is applied to the sheet-shaped member 24 due to a frictional force generated between the sheet-shaped member 24 and the feeding roller 22. On the other hand, the lower edge of the sheet-shaped member 24 is connected to the front end of the lifting member 25*b* to which a downward force (i.e., the force toward an upstream side in the sheet conveyance direction) is applied due to the weight of its own (i.e., the force is a downwardly pulling force, which is hereinafter referred to as "pull-down force").

At the time, if a lift-up force generated by the frictional force is larger than the pull-down force, the sheet-shaped member 24 is lifted up in an arrow T direction illustrated in FIG. 4 and the lifting member 25*b* is rotated in an arrow S direction illustrated in FIG. 4 from its initial position. In other words, the edge of the sheet is raised by the lifting member 25*b*.

Firstly, a state where the sheet-shaped member 24 is lifted up according to the rotation of the feeding roller 22 is described below. At the time, the sheet-shaped member 24 is slipping on the counter member 21. As illustrated in FIG. 5, a force of the feeding roller 22 urging the counter member 21 is N, the frictional force generated between the sheet-shaped member 24 and the counter member 21 is $F_1$, and a force of the feeding roller 22 applied to the sheet-shaped member 24 by the feeding roller 22 in the tangential direction is $F_2$. Further, a vertical component of a resultant force applied to the sheet-shaped member 24 at the nip portion formed between the feeding roller 22 and the sheet-shaped member 24 due to the self weight of the lifting member 25*b* and the weight of the stacked sheets P is $F_3$. In this case, an inequality of $F_3<F_2-F_1$ needs to be satisfied in order to lift up the sheet-shaped member 24 through the nip portion.

When a coefficient of dynamic friction generated between the sheet-shaped member 24 and the counter member 21 is $\mu_1$, since an equation of $F_1=\mu_1 N$ is satisfied, the above equality is represented by $F_3<F_2-\mu_1 N$.

Conditions for lifting up the sheet-shaped member 24 with respect to the feeding roller 22 are described below. When the maximum static frictional force is $F'_2$, since a force at the time that the sheet-shaped member 24 slips on the feeding roller 22 is an upper limit of the force $F_2$, the inequality of $F_3<F_2-\mu_1 N \leq F'_2-\mu_1 N$ is satisfied. Therefore, the following inequality is obtained.

$$F_3<F'_2-\mu_1 N \tag{1}$$

Thus, in order to lift up the sheet-shaped member 24 through the nip portion formed between the feeding roller 22 and the sheet-shaped member 24, it is required to set the component of the resultant force $F_3$ in the vertical direction applied to the sheet-shaped member 24 at the nip portion to satisfy the inequality (1). In the present exemplary embodiment, since $F'_2$ is obtained by utilizing the frictional force of a rubber, the setting needs to be made in the light of a width of the nip portion formed between the feeding roller 22 and the sheet-shaped member 24 (i.e., a length of the nip portion in the sheet feeding direction).

Figure 6:
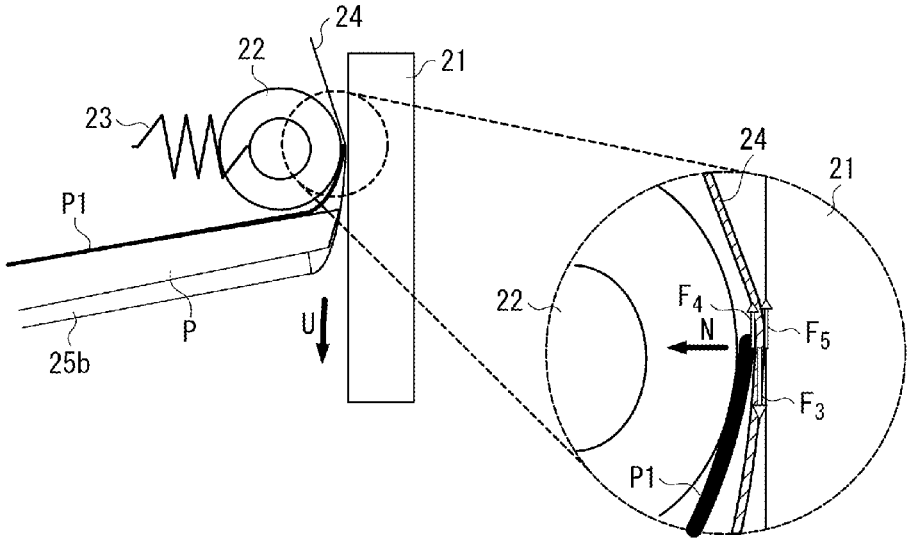
FIG. 6 is a partially enlarged cross sectional view schematically illustrating a state where a sheet is pinched by a nip portion formed between a feeding roller and a sheet-shaped member.

Next, a condition that the sheet-shaped member 24 is pulled down in a downward direction U when the sheet P1 is coming into the nip portion formed between the feeding roller 22 and the counter member 21 is described below with reference to FIG. 6. FIG. 6 is a cross sectional view schematically illustrating a state where the sheet P1 is pinched by the nip portion formed between the feeding roller 22 and the sheet-shaped member 24.

As illustrated in FIG. 6, the static frictional force generated between the uppermost sheet P1 and the sheet-shaped member 24 is $F_4$ and a static frictional force generated between the sheet-shaped member 24 and the counter member 21 is $F_5$. In this case, to allow the sheet-shaped member 24 to move downwardly when the sheet P1 is pinched by the nip portion formed between the feeding roller 22 and the sheet-shaped member 24, an inequality of $F_4+F_5<F_3$ needs to be satisfied.

When a coefficient of static friction generated between the uppermost sheet P1 and the sheet-shaped member 24 is $\mu_4$ and a coefficient of static friction generated between the sheet-shaped member 24 and the counter member 21 is $\mu_5$, an equation $F_4=\mu_4 N$ and $F_5=\mu_5 N$ is satisfied. Consequently, the inequality of:

$$\mu_4 N+\mu_5 N<F_3 \tag{2}$$

is obtained. Accordingly, in order to pull down the sheet-shaped member 24 in the downward direction U by pinching the uppermost sheet P1 in the nip portion formed between the feeding roller 22 and the sheet-shaped member 24, it is required to set the component $F_3$ of the resultant force applied to the sheet-shaped member 24 in the vertical direction so as to satisfy the inequality (2). In other words, a self weight of the lifting member 25*b* or a weight to be attached to the lifting member 25*b* may be adjusted such that the component $F_3$ of the resultant force applied to the sheet-shaped member 24 at the nip portion in the vertical direction satisfies the inequality (2).

As described above, by the rotation of the feeding roller 22, when the sheet-shaped member 24 pinched by the nip portion formed between the feeding roller 22 and the sheet-shaped member 24 is lifted up in the upward direction V and the uppermost sheet P1 is pinched by the nip portion, the inequality (1) and the inequality (2) need to be satisfied at the same time to pull down the sheet-shaped member 24 in the downward direction U. More specifically, the following inequality needs to be satisfied:

$$\mu_4 N+\mu_5 N<F_3<F'_2-\mu_1 N \quad (3)$$

Figure 7A:
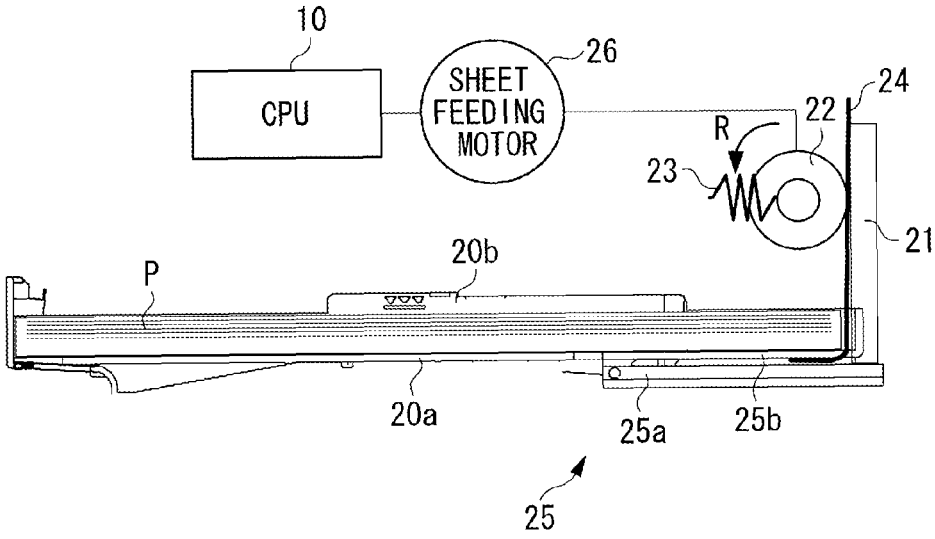
FIG. 7A is a cross sectional view schematically illustrating a state where the lifting member is in an initial position. FIG.
Figure 7B:
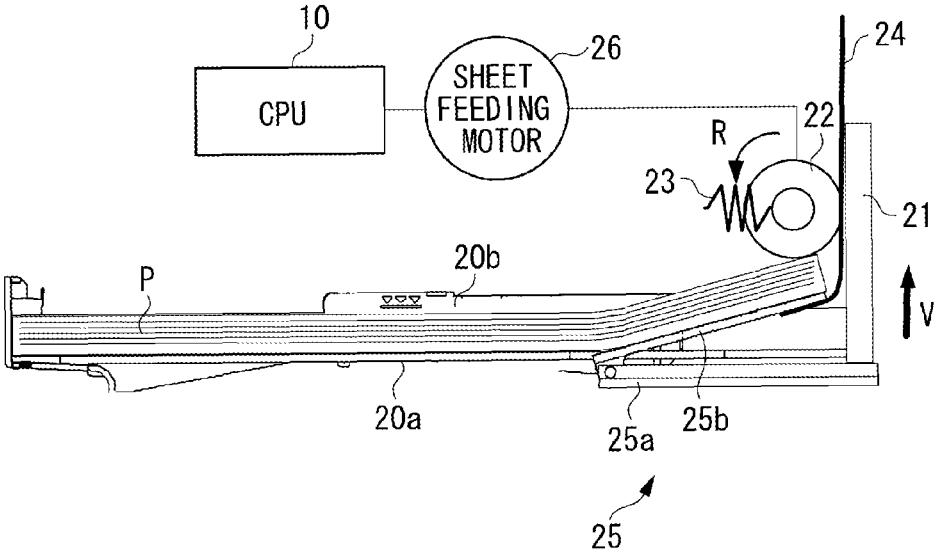

Under the condition that the above described inequality (3) is satisfied, the separation feeding operation for feeding the sheets P by the sheet feeding unit 2 is described below along with a flow chart of FIG. 9 with reference to FIGS. 7 and 8. FIG. 7A is a cross sectional view schematically illustrating a state where the lifting member 25*b* is in the initial position. FIG. 7B is a cross sectional view schematically illustrating a state where the lifting member 25*b* is rotated to bring the sheets P into contact with the feeding roller 22.

FIG. 8A is a cross sectional view schematically illustrating a state where the sheet P1 contacts the feeding roller 22. FIG. 8B is a cross sectional view schematically illustrating a state where the sheet P1 is pinched by the nip portion formed between the feeding roller 22 and the sheet-shaped member 24. FIG. 8C is a cross sectional view schematically illustrating a state where the lifting member 25*b* has returned to the initial position thereof. FIG. 9 is a flow chart illustrating a feeding operation for feeding the sheets P in the sheet feeding unit 2 according to the first exemplary embodiment.

In the state as illustrated in FIG. 7A, the lifting member 25*b* is in the initial position, i.e., a descended state where the lifting member 25*b* is in parallel with the bottom plate 25*a*. In this state, when the CPU (i.e., control unit) 10 receives a print job, a predetermined signal is input into the feed motor 26 from the CPU 10. In step S10, upon receiving the signal, the feed motor 26 rotates to cause the feeding roller 22 connected to the feed motor 26 to rotate in an arrow R direction as illustrated in FIG. 7A for a predetermined number of times.

In step S20, as illustrated in FIG. 7B, when the feeding roller 22 rotates in the arrow R direction for the predetermined number of times, the sheet-shaped member 24 is lifted up. Then, in conjunction with the lift-up of the sheet-shaped member 24, the lifting member 25*b* rotates with leading edge connected to the lower edge of the sheet-shaped member 24. In step S30, when the lifting member 25*b* is rotated, the leading edges of the sheets P positioned on the lifting member 25*b* are lifted up in an upward direction V, so that the uppermost sheet P1 on the lifting member 25*b* contacts the feeding roller 22.

At the time, the lifting member 25*b* rotates around the rotation point, i.e., around the raised portion 25*c* of the bottom plate 25*a*, so that the lifting member 25*b* moves in a direction horizontally away from the counter member 21. Therefore, the sheet-shaped member 24 between the nip portion formed between the feeding roller 22 and the sheet-shaped member 24, and the front end of the lifting member 25*b* is curved.

When the sheet-shaped member 24 curves, as illustrated in FIG. 8A, the leading edge of the bundle of sheets P hereinafter referred to as "sheet bundle") is deformed obliquely along with the sheet-shaped member 24. In the sheet bundle with an obliquely deformed leading edge, the sheets can be easily separated one by one. When the uppermost sheet P1 is brought into contact with the feeding roller 22, the uppermost sheet P1 is guided along with the sheet-shaped member 24 to the nip portion formed between the feeding roller 22 and the sheet-shaped member 24.

As illustrated in FIG. 8B, when the uppermost sheet P1 is pinched by the nip portion formed between the feeding roller 22 and the sheet-shaped member 24, the component $F_3$ of the resultant force applied to the sheet-shaped member 24 at the nip portion in the vertical direction pulls down the sheet-shaped member 24 in the downward direction U, and thus the lifting member 25*b* is rotated in a direction opposite to the above described direction. In steps S40 through S60, as illustrated in FIG. 8C, the uppermost sheet P1 pinched by the nip portion is separated from the other sheets P and the lifting member 25*b* is moved in a direction away from the counter member 21. The operation is repeated until the print job is completed and, in step S70, when the print job is completed, the feeding operation is ended.

As described above, in the laser printer 1, the sheet-shaped member 24 is connected to the lifting member 25*b* capable of lifting up the edges of the sheets. The feeding roller 22 pulls up the sheet-shaped member 24 to lift the sheet and thus lifted sheets come into contact with the feeding roller 22, thereby feeding the uppermost sheet P1. Therefore, without providing a space for flexing the sheets P upwardly, a sheet feeding path can be arranged within a range of a size of the sheet stack tray 20. As a result, downsizing of the sheet feeding unit and downsizing of the laser printer (i.e., the image forming apparatus) equipped with the sheet feeding unit can be achieved.

In the laser printer 1, the sheets are not curved except for during the feed and separating operation, so that the sheets can be prevented from being fixedly curled. For example, some of the conventional laser printers always keep a leading edge of the sheet in a lifted up state even when the laser printer is stopped in a case where the sheet stack tray storing sheets is attached. At the time, since the leading edges of the sheets are lifted up for a long period of time, the sheets are left in a curled condition and thus the sheets may be fixedly curled.

On the other hand, in the present exemplary embodiment, since the sheets are returned to their original condition after the feed and separating operation, curling of the sheets due to the curled condition for a long period of time can be prevented. Accordingly, the sheets P can be fed without degrading the quality of sheets due to the curling on the sheets. Also, a faulty conveyance such as the sheet jam or a faulty transfer caused due to the curling can also be prevented.

As a result, the laser printer 1 can be provided with the sheet feeding apparatus capable of suppressing the occurrence of the faulty conveyance and the degradation of the quality of the sheets, and an image forming apparatus equipped with the sheet feeding apparatus while achieving the downsizing of the laser printer 1.

When the laser printer 1 rotates the feeding roller 22 to lift up the sheets P and the uppermost sheet P1 is brought into contact with the feeding roller 22, the feeding roller 22 feeds the uppermost sheet P1 to the nip portion formed between the feeding roller 22 and the sheet-shaped member 24. When the uppermost sheet P1 is pinched by the nip portion, the lifting member 25*b* descends to separate the uppermost sheet P1 from the sheets P placed below. Therefore, the sheet lifting mechanism and a sheet separation mechanism such as a solenoid or a cam for separating the sheets P placed below after the sheet P1 is fed is no longer necessary. Accordingly, the number of parts can be reduced and thus cost saving can be achieved.

In the laser printer 1, as illustrated in FIG. 10, when the sheet-shaped member 24 is lifted up according to the rotation of the feeding roller 22, the leading edge of the sheet bundle is deformed in a manner as illustrated in FIG. 10 because the leading edge of the sheet bundle is placed along with the curved sheet-shaped member. When the leading edge of the sheet bundle is deformed in a manner as illustrated in FIG. 10B, the sheets P can be separated piece by piece at least at the leading edge of the sheet bundle.

Then, after the completion of the feeding of the sheets P, the lifting member 25*b* is descended to return to the state of FIG. 10A. As described above, repetition of the states of the leading edge of the sheet bundle between the deformed state and the original state divides the sheet bundle. Thus divided sheet bundle decreases the adhesive force between sheets, thereby suppressing the double feed of the sheets P.

When feeding the sheets P, for example, if the uppermost sheet P1 is pinched by the nip portion formed between the feeding roller 22 and the sheet-shaped member 24, there is a case where a second sheet P2 and a third sheet P3 are sent out into the nip portion together with the uppermost sheet P1. However, as illustrated in FIG. 11A, in the laser printer 1, the sheet-shaped member 24 descends when the uppermost sheet P1 is pinched by the nip portion. Therefore, only the uppermost sheet P1 is fed and the second sheet P2 and the third sheet P3 are separated from the uppermost sheet P1. At the time, as illustrated in FIG. 11B, the second sheet P2 and the third sheet P3 slips on the sheet-shaped member 24 to return to the initial state with the leading edges aligned. Accordingly, the laser printer 1 can cause the sheets to return to the aligned state with ease and, for example, can prevent shifting of feeding timing which may be caused by displacement of the leading edges of the sheets from the initial position, without providing an additional mechanism for aligning the leading edges.

A laser printer 1A according to a second exemplary embodiment of the present invention is described below with reference to FIGS. 12 through 14 together with FIG. 1. The laser printer 1A according to the second exemplary embodiment differs from the laser printer 1 of the first exemplary embodiment in that the sheet feeding unit 2A is equipped with a paired second pressure springs 27 and 27 as an urging unit. The urging unit applies an urging force which causes the lifting member 25*b* to return to the initial position. Therefore, in the second exemplary embodiment, the point different from the first exemplary embodiment, i.e., a configuration of the paired second pressure springs 27 and 27 is mainly described and the components similar to those of the laser printer 1 according to the first exemplary embodiment are provided with the same numbers and/or symbols and their descriptions are not repeated.

FIG. 12 is a perspective view illustrating a lifting unit according to a second exemplary embodiment in a state where the lifting unit is detached from the sheet stack tray 20. FIG. 13A is a cross sectional view schematically illustrating a state where the sheets P are stacked on the sheet feeding unit 2A according to the second exemplary embodiment. FIG. 13B is a cross sectional view schematically illustrating a state where the sheets P are brought into contact with the feeding roller 22. In FIG. 12, a paired second pressure springs 27 and 27 which should be indicated with a dotted line, are indicated by a solid line for a clear understanding.

As illustrated in FIGS. 12 and 13, the paired pressure springs 27 and 27 are disposed between the bottom plate 25*a* and the lifting member 25*b* and one ends thereof are connected to the bottom plate 25*a* and the other ends thereof are connected to the lifting member 25*b*. The paired pressure springs 27 and 27 press the lifting member 25*b* downwardly such that the lifting member 25*b* returns to the initial position. For example, when the feeding roller 22 rotates in the R direction illustrated in FIG. 12 and the sheet-shaped member 24 is lifted up in an arrow T direction illustrated in FIG. 12, the paired second pressure springs 27 and 27 are expanded to strengthen the force for pulling back the lifting member 25*b* downwardly (see, FIG. 13B).

In the first exemplary embodiment, the force to pull down the lifting member 25*b* to the initial position is a resultant force of a self weight of the lifting member 25*b*, the weight attached to the lifting member 25*b*, and a weight of the sheets P stacked on the lifting member 25*b*. In the second exemplary embodiment, an urging force of the paired second pressure springs 27 and 27 is added to the resultant force. Therefore, provided that the sum of $F_3$ described in the first exemplary embodiment and the urging force of the paired second pressure springs 27 and 27 is $F'_3$, the inequality of $$\mu_4 N+\mu_5 N<F'_3<F'_2-\mu_1 N \tag{4}$$

needs to be satisfied. More specifically, in the second exemplary embodiment, the urging force of the paired second pressure springs 27 and 27 needs to be set such that the inequality (4) is satisfied.

An effect of the laser printer 1A according to the second exemplary embodiment is described below with reference to FIG. 14. FIG. 14 illustrates a relationship between the number of stacked sheets and the resultant force in the vertical direction.

The second exemplary embodiment differs from the first exemplary embodiment in that the paired second pressure springs 27 and 27 are added and the effect thereof is the difference between $F_3$ and $F'_3$. Firstly, $F_3$ and $F'_3$ are marthematized. $F_3$ and $F'_3$ increase as the number of stacked sheets P increases. Therefore, $F_3$ and $F'_3$ can be expressed by the number of stacked sheets set as a variable and by the component of the resultant force in the vertical direction set as a function. Therefore, $F_3$ can be expressed as a resultant force of the self weight of the lifting member 25*b*, the weight attached to the lifting member 25*b*, and the weight of the sheets P stacked on the lifting member 25*b* by the equation:

$$F_3=pA\times S+B \tag{5}$$

where S is the number of stacked sheets, A is a weight of a piece of sheet, p is a ratio of weight added to the lifting member to the self weight of the sheets, and B is the sum of the self weight of the lifting member and a value of the weight.

$F'_3$ is the sum of $F_3$ and the urging force of the second pressure springs 27 and 27, so that when the sum is substituted into the equation (5):

$$F'_3=k(C-D\times S-E)+pA\times S+B+G$$

$$F'_3(pA-kD)S+B+kC-KE+G \tag{6}$$

where k is a spring constant, C is a thickness at the time of the maximum stack of the sheets, D is a thickness of a piece of A4 size sheet, E is an initial distance between the feeding roller and an upper surface of the stacked sheets, and G is an initial tension of the pressure spring.

FIG. 14 is a graph illustrating a relationship between $F_3$ and $F'_3$. FIG. 14 is obtained by substitution of the following values into the equation (5): A=0.05N, p=0.4, B=5.0N, k=0.1N/mm, C=8 mm, D=0.07 mm, E=2 mm, and G=0.5N, and by substitution of the following values into the equation (6): A=0.05N, p=0.4, B=5.5N, k=0.1N/mm, C=8 mm, D=0.07 mm, E=2 mm, and G=0.5N. These values are mere examples for the sake of the description of the present exemplary embodiment and thus the present invention is not limited thereto.

In FIG. 14, a lateral axis represents the number of stacked sheets, a longitudinal axis represents the resultant force in the vertical direction, $F_3$ is represented by a dotted line, and $F'_3$ is represented by a solid line. The alternate long and short dashed lines represent an upper limit and a lower limit of $F_3$ and $F'_3$ (i.e., inequalities (3) and (4)).

When the values of $F_3$ and $F'_3$ become larger than the upper limit, the feeding roller 22 idle-slips on the sheet-shaped member 24 and thus the sheet-shaped member 24 would not be lifted, whereas, when the values of $F_3$ and the $F'_3$ become smaller than the lower limit, the sheet-shaped member 24 would not descend. As a result, the present exemplary embodiment cannot be carried out.

$S_0$ represents the maximum number of the stacked sheets P. Here, $\mu_4$=0.5, $\mu_5$=0.5, $F'_2$=10N, $\mu_1$=0.5, and $S_0$=150. An obliquely lined portion T illustrated in FIG. 14 represents a margin of $F_3$ required in the first exemplary embodiment when the number of sheets is within a range between 0 and $S_0$. A region U represents a margin of F'3 in the second exemplary embodiment. The region U is the sum of Q1 and Q2 (U=Q1+Q2).

An obliquely lined portion T is represented by q1+q2. When the values are compared, Q1+Q2>q1+q2 is established and thus it can be seen that the margin of the second exemplary embodiment becomes wider than the margin of the first exemplary embodiment. This is because the coefficient related to S becomes smaller due to an effect of the spring constant k. Why the coefficient related to S becomes smaller is because a load of a piece of sheet added to the lifting member 25*b* is subtracted owing to the spring force as known from the coefficient related to S of the equation (6).

The coefficient related to S of the equation (6) becomes smaller when an effect produced by the self weight of the recording paper (i.e., the sheet) is made smaller by the second pressure springs 27 and 27. As a result, an inclination of the equation (6) becomes smaller and the force applied to the lifting member 25*b* does not fluctuate but stable regardless of the number of stacked sheets.

As described above, while the coefficient related to S of the equation (6) becomes smaller, q1 becomes Q1 and q2 becomes Q2, i.e., the margins with respect to the upper limit and the lower limit illustrated by the alternate long and short dashed lines in FIG. 14 become wider. In other words, since ranges of values obtainable by the equations of $\mu_4N+\mu_5N$ and $F'_2-\mu_1N$ become wider, options of materials, surface shapes, rubber hardness, and pressing forces of the feeding roller 22, the counter member 21, and the sheet-shaped member 24 can be opened up. Accordingly, the margins of the design values for selecting the materials increase and thus designing flexibility can be expanded. As a result, for example, a material suitable for a specification can be suitably selected from, for example, more inexpensive material and a material having a fire-resistance.

A laser printer 1B according to a third exemplary embodiment of the present invention is described below with reference to FIGS. 15 through 17 together with FIG. 1. The laser printer 1B according to the third exemplary embodiment differs from the laser printer 1A according to the second exemplary embodiment in that a driven roller 28 is provided instead of the counter member 21 in a sheet feeding unit 2B and the driven roller 28 is pressed against the feeding roller 22 with the third pressure spring 29 serving as the first urging unit. Therefore, in the third exemplary embodiment, a configuration different from that of the second exemplary embodiment, i.e., the configuration of the driven roller 28, is mainly described below and the components similar to those of the laser printer 1A according to the second exemplary embodiment are provided with the same numbers and/or symbols and descriptions thereof are omitted.

FIG. 15A is a cross sectional view schematically illustrating a state where the sheets P are stacked on a sheet feeding unit 2B according to the third exemplary embodiment. FIG. 15B is a cross sectional view schematically illustrating a state where the sheets P are brought into contact with the feeding roller 22 according to the third exemplary embodiment. FIG. 16A is a partially enlarged cross sectional view schematically illustrating a lifting unit illustrated in FIG. 15B. FIG. 16B is a partially enlarged cross sectional view schematically illustrating a state where the sheet P1 comes into a nip portion formed between the feeding roller 22 and the driven roller 28 of FIG. 16A.

As illustrated in FIG. 15, the driven roller 28 is disposed opposite to the feeding roller 22 and is pressed against the feeding roller 22 via the third pressure spring 29, thereby forming the nip portion between the driven roller 28 and the feeding roller 22. The driven roller 28 is formed such that the polyurethane rubber is molded on and around a shaft of the SUS and is rotatable according to the rotation of the feeding roller 22. The sheet-shaped member 24 is pinched by the nip portion formed between the feeding roller 22 and the driven roller 28 and is lifted upwardly according to the rotation of the feeding roller 22 in the arrow R direction illustrating in FIG. 15.

A sheet feeding unit 2B according to the third exemplary embodiment differs from the first exemplary embodiment and the second exemplary embodiment in a relationship of the force generated at the nip portion when the sheet P1 is pinched by the nip portion formed between the feeding roller 22 and the driven roller 28 and the sheet-shaped member 24 is pulled down. Therefore, the relationship of the force between the feeding roller 22 and the driven roller 28 at the nip portion is described below with reference to FIG. 16.

As illustrated in FIG. 16A, in the first exemplary embodiment and the second exemplary embodiment, a frictional force $F_1$ generated between the counter member 21 and the sheet-shaped member 24 (see, FIG. 5) becomes 0 (i.e., $F_1$=0) since the driven roller 28 is driven by the feeding roller 22. Further, as illustrated in FIG. 16B, a static frictional force $F_5$ (see, FIG. 6) generated between the sheet-shaped member 24 and the counter member 21 in the first exemplary embodiment becomes 0 (i.e., $F_5$=0) since the driven roller 28 is driven by the feeding roller 22. Accordingly, the above described inequality (4) becomes:

$$\mu_4 N < F'_3 < F'_2 \tag{7}$$

An effect produced by the laser printer 1B having the above described configuration according to the third exemplary embodiment is described below with reference to FIG. 17. FIG. 17 illustrates a relationship between the number of stacked sheets P and the resultant force in the vertical direction.

In FIG. 17, a lateral axis represents the number of stacked recording papers (i.e., sheets) and a longitudinal axis represents the resultant force in the vertical direction. In FIG. 17, $F'_3$ is represented by a solid line. FIG. 17 illustrates an allowable range of $F'_3$ represented by the equation (6), and inequalities (4) and (7). As illustrated in FIG. 17, it can be seen that the allowable range becomes wider by an obliquely lined portions illustrated in FIG. 17 because of the equation (7). In other words, it can be seen that the allowable range of $F'_3$ becomes wider by replacing the counter member 21 with the driven roller 28 which is rotated by the feeding roller 22. Accordingly, the setting value of each variable of the equation (6) can be determined more freely.

Since the allowable ranges of the weight and the thickness of the sheets which can be used become wider, so that the thickness and the type of the sheets which can be used can be set wider in comparison with those of the first exemplary embodiment and the second exemplary embodiment.

Further, a third pressure spring 29 as a first urging unit is disposed in a side of the driven roller, so that a arrangement flexibility of the feeding roller 22 and a rigidity of the feeding roller 22 can be improved, thereby enabling a stable feeding of the sheets P.

The exemplary embodiments of the present disclosure are described above; however, the present invention is not limited to the above described exemplary embodiments. The effects produced in the above described exemplary embodiments of the present invention are mere examples which achieve the optimum effects of the present invention and the effects of the present invention are not limited to what are described in the exemplary embodiments of the present invention.

For example, in the present exemplary embodiment, the feeding roller 22 is pressed against the counter member 21 via the first pressure spring 23; however, the present invention is not limited thereto. For example, the counter member 21 may be pressed against the feeding roller 22. In this case, the counter member 21 may be pressed by the pressure spring. Alternatively, the counter member 21 may be elastically deformed to be pressed against the feeding roller 22.

In the present exemplary embodiment, the first pressure springs 23 and 23 are described as the first urging unit in the present text; however, the present invention is not limited thereto. The first urging unit may be pressed by, for example, an elastic rubber.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-004053 filed Jan. 12, 2012, which is hereby incorporated by reference herein in its entirety.

What is claimed is:

1. A sheet feeding apparatus for feeding sheets stacked on a sheet stacking face of a sheet stack tray, comprising:

a feeding roller configured to feed the sheets;

a driving motor configured to rotate the feeding roller;

a lifting member configured to move at least edges of the sheets in a direction of the feeding roller;

a sheet-shaped member connected to a front end of the lifting member at a downstream side in a sheet conveyance direction; and a counter member disposed opposite to the feeding roller and facing the feeding roller across the sheet-shaped member to pinch the sheet-shaped member;

wherein, when the feeding roller is rotated, the sheet-shaped member pinched between the feeding roller and the counter member is moved to a downstream side in the sheet conveyance direction to cause the lifting member to move, and when the sheets are brought into contact with the feeding roller, the thus contacted uppermost sheet on the sheet stacking face of the sheet stack tray is fed by the feeding roller.

2. The sheet feeding apparatus according to claim 1, wherein a frictional force generated between the sheet-shaped member and the fed sheet, and a frictional force generated between the sheet-shaped member and the counter member are less than a force for pulling down the sheet-shaped member; and wherein, when a sheet stacked on the sheet stacking face of the sheet stack tray is fed by the feeding roller to come into a nip portion pinching the sheet-shaped member between the feeding roller and the counter member, the sheet-shaped member is pulled to the upstream side in the sheet conveyance direction.

3. The sheet feeding apparatus according to claim 2, further comprising an urging unit configured to apply a force for pulling the sheet-shaped member to the upstream side in the sheet conveyance direction, to the sheet-shaped member or the lifting member.

4. The sheet feeding apparatus according to claim 1, wherein, when the sheet-shaped member is moved to the downstream side in the sheet conveyance direction, a front end of the lifting member at the downstream side in the sheet conveyance direction is positioned at an upstream side of leading edge of the sheet in the sheet conveyance direction.

5. The sheet feeding apparatus according to claim 1, wherein the counter member comprises a driven roller rotatable by the feeding roller.

6. An image forming apparatus including a sheet feeding apparatus for feeding sheets stacked on the sheet stacking face of the sheet stack tray and an image forming unit for forming images on the sheets fed by the sheet feeding apparatus, wherein the sheet feeding apparatus comprises:

a feeding roller configured to feed the sheets;

a driving motor configured to rotate the feeding roller;

a lifting member configured to move at least edges of the sheets in a direction of the feeding roller;

a sheet-shaped member connected to a front end of the lifting member at a downstream side of the sheet conveyance direction; and a counter member disposed opposite to the feeding roller and facing the feeding roller across the sheet-shaped member to pinch the sheet-shaped member;

wherein, when the feeding roller is rotated, the sheet-shaped member pinched between the feeding roller and the counter member is moved to a downstream side in the sheet conveyance direction to cause the lifting member to move and, when the sheets are brought into contact with the feeding roller, the contacted uppermost sheet on the sheet stacking face of the sheet stack tray is fed by the feeding roller.

* * * * *